US006101647A

United States Patent [19]

Stroud et al.

[11] Patent Number: 6,101,647

[45] Date of Patent: Aug. 15, 2000

[54] ADJUSTABLE BED

[75] Inventors: David W. Stroud, Linwood; Paul E. Pottschmidt, Lexington, both of N.C.

[73] Assignee: L&P Property Management Company, Southgate, Calif.

[21] Appl. No.: 09/037,368

[22] Filed: Mar. 10, 1998

[51] Int. Cl.[7] ..... A47B 7/02

[52] U.S. Cl. ..... 5/618; 5/613; 5/616

[58] Field of Search ..... 5/613, 616, 617, 5/618

[56] References Cited

U.S. PATENT DOCUMENTS

| | | | |
|---|---|---|---|
| D. 255,402 | 6/1980 | Lundgren . | |
| 3,898,702 | 8/1975 | Goodman | 5/618 |
| 4,381,571 | 5/1983 | Elliott . | |
| 4,385,410 | 5/1983 | Elliott et al. . | |
| 4,407,030 | 10/1983 | Elliott . | |
| 5,438,723 | 8/1995 | Carroll | 5/618 X |
| 5,537,701 | 7/1996 | Elliott . | |
| 5,544,376 | 8/1996 | Fromson . | |
| 5,568,661 | 10/1996 | Bathrick et al. . | |
| 5,577,280 | 11/1996 | Elliott . | |
| 5,579,550 | 12/1996 | Bathrick et al. . | |
| 5,600,214 | 2/1997 | Fromson . | |
| 5,608,932 | 3/1997 | Hasegawa | 5/618 X |
| 5,640,730 | 6/1997 | Godette . | |

*Primary Examiner*—Michael F. Trettel
*Assistant Examiner*—James M Hewitt
*Attorney, Agent, or Firm*—Wood, Herron & Evans, L.L.P.

[57] ABSTRACT

An adjustable bed having an upper frame mounted to translate with respect to a lower frame. A center support is connected to the upper frame and has a head support pivotally connected to one end thereof. A thigh support is pivotally connected to the other end of the center support and a foot support is connected to the other end of the thigh support. First and second motors are operatively connected between the upper frame and the head and thigh supports to pivot the head and thigh supports with respect to the center support. The upper frame is linked to the lower frame so that as the head support is pivoted up, the upper frame is translated toward the head end of the bed, thereby maintaining the head support at a relatively fixed position with respect to appliances and furniture adjacent the head end of the bed.

23 Claims, 7 Drawing Sheets

ADJUSTABLE BED

BACKGROUND OF THE INVENTION

This invention relates generally to beds and more particularly to powered adjustable beds. Adjustable beds have been used for many years to permit the user to adjust the head and foot sections of the bed to different positions. While originally only manually adjustable, more recently, the head and foot sections are moved by motors operated by the user via a remote control.

Adjustable beds were originally designed principally for use in medical environments by patients who had to spend long periods of time in bed for reasons of health, injury, etc. However, more recently, adjustable beds are also being used in residential environments by users who have no health or physical impairment. An increasing number of people place televisions and other media based entertainment devices in the bedroom, and more time is spent lounging in bed. Hence, the bed, and in particular an adjustable bed, is considered by many users an alternative piece of leisure furniture. As the market for leisure beds grows, there is continuing effort by suppliers to provide leisure beds that are more comfortable, have more options, for example, massage capabilities, have more sophisticated controls, and are more affordable.

One recent development in adjustable beds is the development of a "wallhugger" adjustable bed. The function of a wallhugger adjustable bed is to maintain the user in the same position with respect to adjacent appliances and furniture as the head portion of the bed is moved between flat and elevated positions. To achieve that purpose, as the head section pivots upward, an upper bed frame portion translates toward the head end of the bed with respect to a stationary lower bed frame section. One example of such a bed is disclosed in U.S. Pat. No. 5,577,280. There are numerous complexities in known adjustable bed designs. For example, referring to FIG. 11 of the '280 patent, the motors 92, 96 have respective drive shafts extending under the head and thigh sections, respectively. Thus, when the head and thigh sections are elevated, the motor shafts and elevation linkage are visible. In addition, referring to FIG. 5 of the '280 patent, torque tube 182 rotates about a pivot point 180. That swinging or rotating of torque tube 182 about a point noncoincident with its centerline requires a relatively complex and expensive structure. Further referring to FIGS. 3 and 1 of the '280 patent, links 264 are pivotally connected to brackets 271 which are rigidly connected to side rails 154. Such a construction creates undesirable or torsional forces at the extreme ends of the side rails 154. The '280 patent also discloses in FIGS. 17–19, a mechanism by which the upper frame is translated on the lower frame. The mechanism includes upper and lower wheels that capture a horizontal track mounted on the lower frame.

Thus, there is a need to provide a wallhugger bed which is simpler in construction and less expensive without compromising the comfort, support and utility to the user.

Known adjustable beds further include sophisticated controls that provide a user with many features that facilitate the user's control of the bed. For example, known bed controls include a position set push button which permits the user to store a combination of head and foot positions that define a favorite bed configuration. In addition, the control includes a favorite position button which, when pressed, automatically moves the bed to the stored favorite head and foot positions previously selected by the user. In addition, with known systems, the position set push button, in addition to storing the selected head and foot positions, also stores the selected speed of the head and foot vibrator motors. Thus, when the favorite position button is depressed, not only does the bed move to the stored favorite position but the vibrator motors operate at the stored speed. Thus, known bed controls provide no facility for independently selecting and storing a favorite vibrator motor setting. Thus, there is a need to provide further control enhancements which permit the user to store and recall favorite vibrator motor settings independent of bed position.

SUMMARY OF THE INVENTION

The present invention provides an adjustable bed that is simpler in construction, less expensive to manufacture and more compact and streamlined in appearance. Further, the invention provides additional control versatility with respect to the ability of users to store and recall vibrator motor settings. Thus, the adjustable bed of the present invention is especially useful as a piece of leisure furniture in a generally residential environment.

According to the principles of the present invention and in accordance with the preferred embodiments, the adjustable bed of the present invention includes a bed frame on which is supported a center support section for supporting the hips of the user. A head support section is pivotally connected to the head end of the center support section and a thigh support section is pivotally connected to the foot end of the center support section. A first member is connected to the bed frame below the center support section and closer to the head end than the foot end. A second member is connected to the bed frame at a location below the center support section and between the first member and the foot end of the frame. A first motor and drive is mechanically connected between the second member and the head support section and moves the head support section through a pivoting motion with respect to the center support section. A second motor and drive is mechanically connected between the first member and the thigh support section and moves the thigh support section through a pivoting motion with respect to the center support section.

Thus, the motors and drive mechanisms are mounted side by side below the center support section. With such a construction, the motors and associated drive mechanisms are less visible when the head and foot sections are elevated than with known adjustable beds. Therefore, the bed in its elevated position is aesthetically more pleasing. In addition, the center mounting of the motors provides more flexibility in terms of motor stroke selection and permits an overall shorter bed frame. In addition, the motors are mounted on separate cross members so that there is better mechanical isolation between the motors and their associated support mechanisms with the advantage of providing a smoother operation.

In another embodiment of the invention, the adjustable bed includes an actuator shaft rotatably supported by the side rails of the bed frame to provide an axis of rotation for the actuator shaft coincident with the longitudinal center line of the actuator shaft but not intersecting the vertical members of the side rails of the bed frame. The actuator shaft is mechanically connected between the motor and the first support section to pivot the first support section with respect to the center support section in response to the first motor rotating the first actuator shaft with respect to its center line. The above construction provides a linkage that elevates the first support section by simply rotating the actuator shaft with respect to its center line. This is in contrast to prior art constructions in which the actuator shaft is swung about a pivot point noncoincident with its center line. The claimed construction is substantially simpler with the advantage of being less expensive and equally reliable in operation.

In a further embodiment of the invention, the adjustable bed further includes a foot support section having one end pivotally attached to the opposite end of the thigh support section. Foot support linkage has one end attached to the foot support section and an opposite end attached to the frame at a location between, but not in contact with, the side rails. In one aspect of the invention, the opposite end of the linkage is attached to a cross member extending between the side rails. Such a construction has the advantage of permitting bed trim pieces to be applied directly to the exterior of the side rails, thereby minimizing the width of the overall bed. In addition, moving the linkage inward from the side rails minimizes the potential for interference with the side frame. Further, mounting the links on a cross rail provides a more substantial structure than the ends of the side rails and has the advantage of providing a stronger and more stable foot section.

In a still further embodiment of the invention, the adjustable bed includes an upper frame movably mounted on a lower frame by means of a plurality of wheel supports. Each of the wheel supports includes a generally C-shaped bracket having an upper end connected to the upper bed frame. In addition, a wheel is rotatably supported by the C-shaped bracket and is in rolling contact with a surface on the lower bed frame. A cap is attached to the lower end of the C-shaped bracket and is normally spaced a distance from a vertical member of the lower frame so that the cap contacts the vertical member of the lower frame upon the wheel moving toward the vertical member. Thus, the plurality of wheeled supports help maintain the upper frame moving along a desired track with respect to the lower frame. The above construction is relatively simple and has the advantage of being relatively inexpensive while effectively tracking the upper frame with respect to the lower frame.

In another embodiment of the invention, the adjustable bed includes a position motor and drive mechanically coupled to a support section for moving the support section through a pivoting motion with respect to the center support section which is supported by the bed frame. A vibrator motor is mounted to the support section. A motor control has a plurality of user operated input devices and outputs which are connected to the position and vibrator motors. The motor control has a first input device or push button for commanding the position motor to move the first support section to selected angular positions with respect to the center support section. A second input device commands an operational state of the vibrator motor and a third input device commands the motor control to store only a currently selected operational state of the vibrator motor and not a currently selected position of the position motor. In one aspect of the invention, a fourth input device commands a vibrator motor to operate in accordance with the stored operational state. In another aspect of the invention, the operational state may be a selected motor speed or a selected rate of change of motor speed. The above control provides set and play back controls for only the vibrator motor and thus provides the user the capability of storing and replaying desired vibrator motor settings exclusive of the bed position. Thus, the storage and playback of the vibrator motor is independent of the position of the movable bed sections.

These and other objects and advantages of the present invention will become more readily apparent during the following detailed description taken in conjunction with the drawings herein, in which:

DETAILED DESCRIPTION OF THE INVENTION

Figure 1:
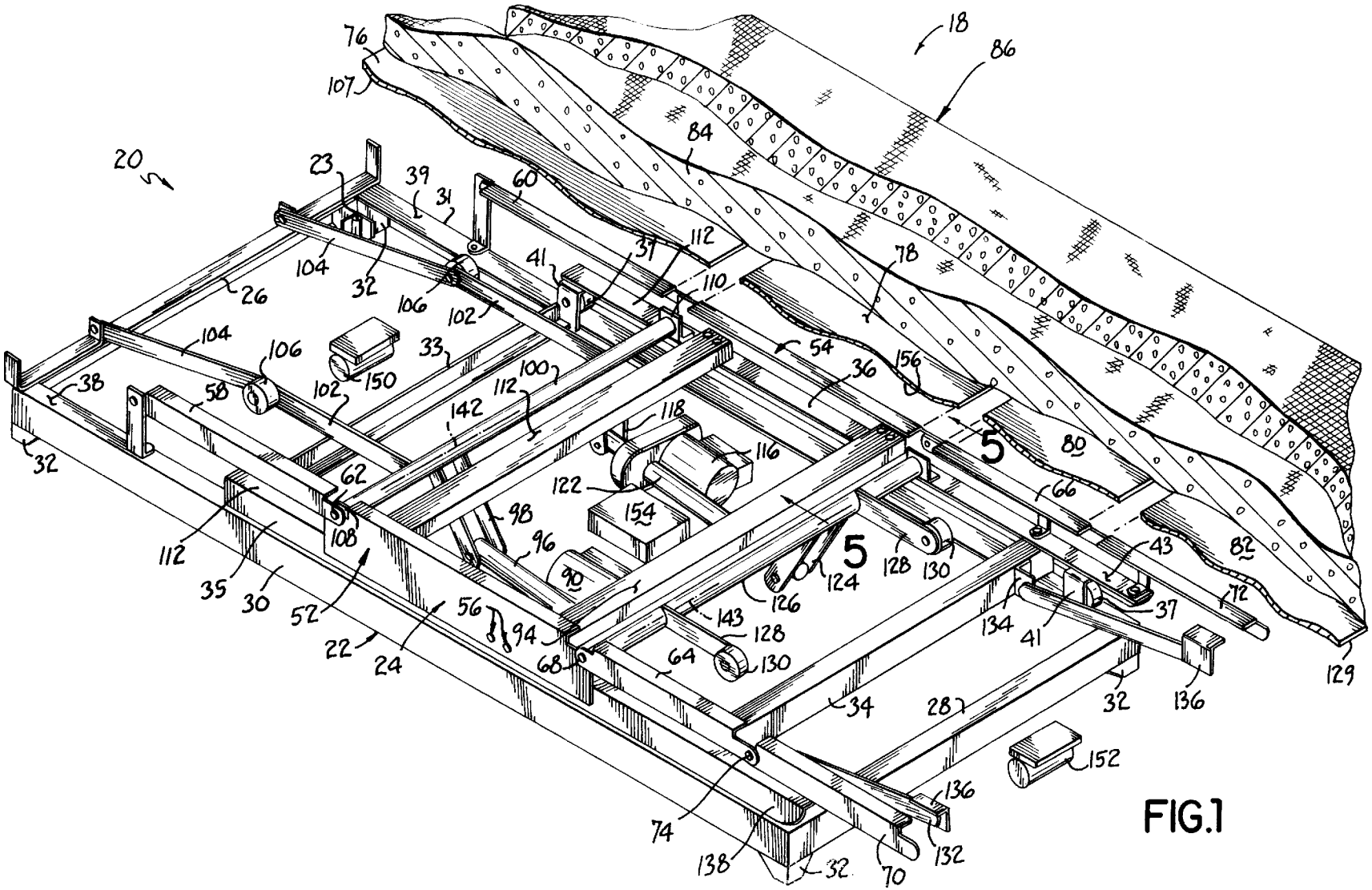
FIG. 1 is a perspective view of a wallhugger adjustable bed frame and associated mattress components in accordance with the principles of the present invention.

Referring to FIG. 1, an adjustable bed 18 includes a bed frame 20 comprised of a lower frame 22 and an upper frame 24 movably mounted on the lower frame 22. The lower frame 22 has head and foot end rails 26, 28 respectively, and left and right side rails 30, 31, respectively. The rails 26–31 are joined at their ends with corner brackets 32 to form a generally rectangular frame section. Each of the castors 32 includes a caster bracket 23 for receiving the stem of the castor (not shown) that supports the adjustable bed 18 on the floor. The upper frame 24 includes a head rail 33, a foot rail 34 and left and right side rails 35, 36, respectively. The rails 33–36 are rigidly connected at their ends with fasteners to form a generally rectangular upper frame 24. The upper frame side rails 35–36 are made of angle stock similar to the lower frame rails 26–31. The upper frame 24 is movably mounted on the lower frame 22 by four wheels 37 which are rotatably mounted to the ends of the left and right side rails 35, 36 and contact, and track, on the respective upper surfaces 38, 39 of the left and right lower frame side rails 30, 31, respectively.

Figure 4:
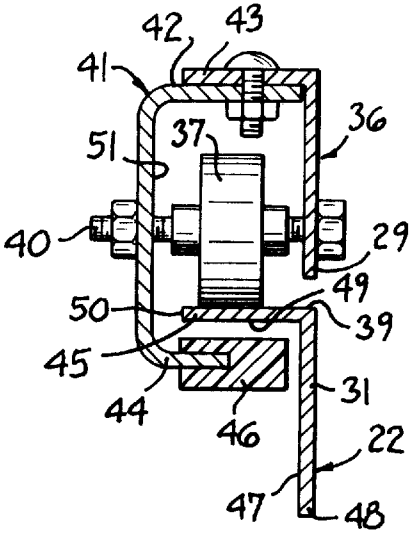
FIG. 4 is a cross-sectional view taken along line 4—4 of FIG. 3.
Figure 3:
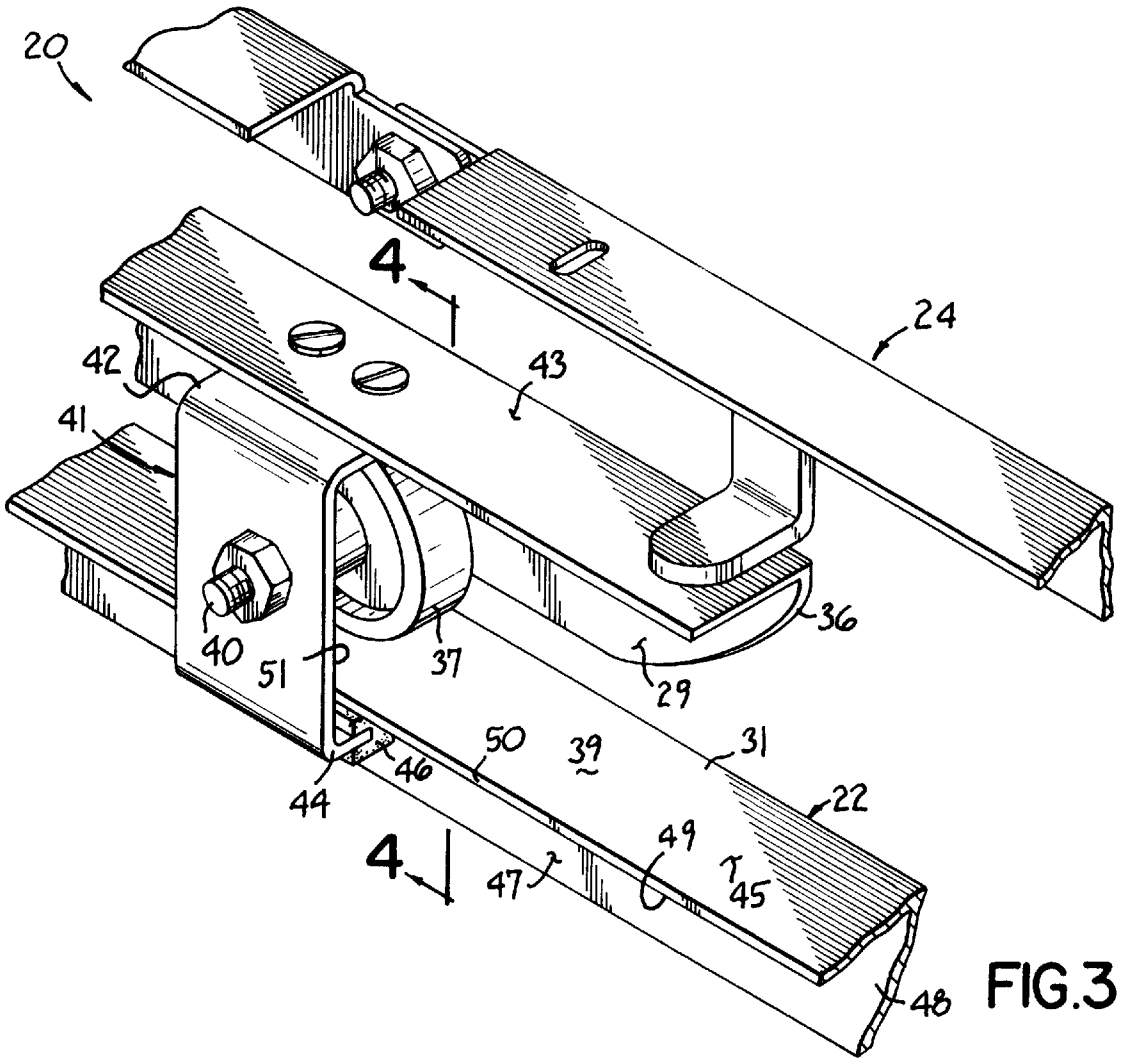
FIG. 3 is a partial perspective view of a wheel mounting assembly providing relative translation between the upper and lower frame sections in accordance with the principles of the present invention.

FIGS. 3 and 4 illustrates the details of the attachment of one of the wheels 37, and more specifically, the wheel attached at the foot end of the right side rail 36 of the upper frame 24. The mounting of the other three wheels is identical to that illustrated in FIG. 3. Each of the wheels 37 is rotatably mounted to on an axle 40, for example, a shoulder bolt having one end attached to a generally C-shaped wheel hanger bracket 41. An opposite end of axle 40 is attached to a vertical flange 29 of the right side rail 36. An upper end 42 of the wheel bracket 41 is attached by bolts or rivets to a horizontal flange 43 of the right side rail 36. A lower leg 44 of the wheel mounting bracket 41 extends beneath a horizontal flange 45 of the right side rail 31 of the lower frame 22. A bumper or pad 46, made from a plastic or other low friction material, is mounted over the end of the lower leg 44 of the bracket 41.

The pad 46 is sized such that under normal operation, the pad maintains a predetermined distance, for example 0.100 inches, from an inner surface 47 of the vertical flange 48 of the right side rail 31 and a lower surface 49 of the horizontal flange 45. Further, the lower end 44 of the wheel mounting bracket 41 is sized such that under normal operating conditions, the distance between the edge 50 of the horizontal flange 45 and the inner surface 51 of the bracket 41 is greater than the distance between the pad 46 and the inner surface 47 of the vertical flange 48. Thus, if the wheel 37 tracks to the right as viewed in FIG. 3, the pad 46 will contact the inner surface 47. However, the edge 50 of the horizontal flange 45 will never contact the inner surface 51 of the wheel bracket 41. Thus, the pads 46 located on respective wheel brackets 41 at the corners of the upper frame 22 help track the wheels 37 along the respective upper surfaces 38, 39 of the respective side rails 30, 31 of the lower frame 22. The head end rail 33 is mounted between and rigidly connected to the brackets 41 at the head end to further facilitate proper tracking of the head end wheels during the translation of the upper frame 24.

Referring again to FIG. 1, left and right center hinged members 52, 54 are attached to respective left and right upper frame side rails 35, 36 by fasteners 56, for example, bolts or rivets. Left and right head hinges 58, 60 are pivotally connected by pivot pins 62, for example, bolts and rivets, to respective left and right center hinges 52, 54. The opposite ends of the center hinges 52, 54 are pivotally connected to respective left and right thigh hinges 64, 66 by pivot pins 68. The other ends of the left and right thigh hinges 64, 66 are pivotally connected to the ends of respective left and right foot hinges 70, 72 by pivot pins 74.

A head support board 76 has a width extending the full width of the bed frame and is attached by fasteners to the head hinges 58, 60. In a similar manner, a center support board 78, thigh support board 80 and foot support board 82 extend between and are fastened to the respective center hinges 52, 54, thigh hinges 64, 66 and foot hinges 70, 72. A mattress base 84, for example, a foam pad, is mounted over and covers the head, center, thigh and foot boards 76–82. Normally, the boards 76–82 and mattress base 84 are enclosed within a covering (not shown). A mattress 86 is then laid over the base 84.

A head motor 90 is pivotally mounted to a trunnion motor mount 92 attached to a head motor mount rail 94 extending between and connected to the upper left and right side rails 35, 36. A distal end of the drive shaft 96 of motor 90 is pivotally connected to distal ends of head crank arm links 98. The proximal ends of the crank arm links 98 are rigidly connected to a head actuator shaft 100. The head actuator shaft 100 is rigidly connected to the proximal ends of a pair of head lift arms 102. The pair of head left lift arms 102 are angularly displaced on the actuator shaft 100 from the crank arm links 98 by approximately 120°. The distal ends of the proximal lift arms 102 are rotatably connected to distal ends of head arm links 104. The proximal ends of the head arm links 104 are pivotally connected to the head rail 26 of the lower frame 22. Lift rollers 106 are rotatably connected to the pivot joining the arms 102, 104. The lift rollers 106 normally bear against a left plate (not shown) attached to the underside 107 of the head board 76.

Figure 5:
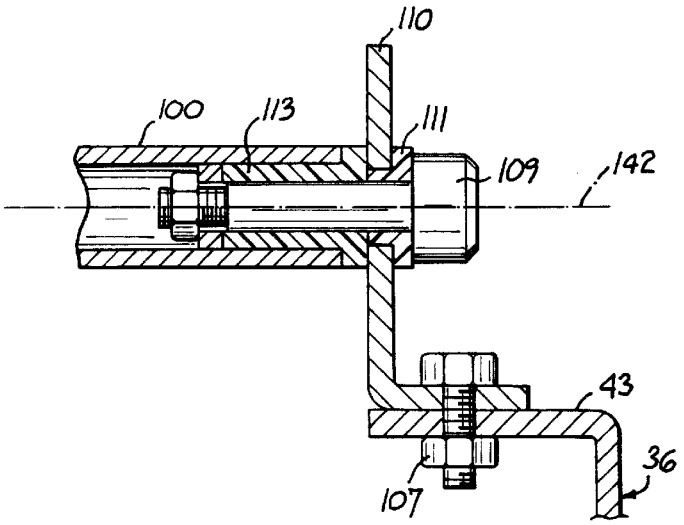
FIG. 5 is a cross-sectional view taken along line 5—5 of FIG. 1.

The ends of the head actuator shaft 100 are rotatably mounted in left and right brackets 108, 110, and the brackets 108, 110 are rigidly connected to the upper surfaces 112 of the respective left and right side rails 35, 36 of the upper frame 24. FIG. 5 is illustrative of how both ends of each of the actuator shafts 100, 126 is mounted to the upper side rails 35, 36. More specifically, FIG. 5 illustrates the mounting of the right end of the actuator shaft 100 to bracket 110 on the upper right side rail 36. The bracket 110 is mounted to the upper surface of the horizontal flange 43 of the right side rail 36 of the upper frame 24 by fasteners 107, for example, bolts or rivets. A fastener 109, for example, a shoulder bolt, extends through a hanger bushing 111 mounted in a hole within the hanger bracket 110. The shoulder bolt 109 then extends through an actuator bushing 113 which is press fit into the end of the actuator shaft 100. The fastener 109 includes a washer and nut to hold the shoulder bolt in place. The bushings 111, 113 are made from a durable low friction material such as a "NYLON" plastic material.

Referring back to FIG. 1, a motor 116 is connected to a trunnion motor mount 118 that, in turn, is connected to a motor mount crossrail 120 extending between and connected to the upper side rails 35, 36. The distal end of a motor drive shaft 122 is pivotally connected to the distal ends of crank arm links 124. The proximal ends of the crank arm links 124 are rigidly attached to a foot actuator shaft 126. A pair of foot lift arms 128 which are rigidly connected at their proximal ends to the foot actuator shaft 126 are angularly displaced, for example, by 120°, from the crank arm links 124. Foot lift rollers 130 are rotatably connected to the distal ends of the foot lift arms 128. The foot left rollers 130 normally bear against left plates (not shown) that are attached to the underside 129 of the foot board 82. A pair of foot support arms 132 are pivotally connected at their proximal ends to brackets 134 which in turn are rigidly connected to the foot end rail 34. The distal ends of the foot support arms 132 are pivotally connected to brackets 136 which in turn are attached to the lower side 129 of the foot board 82.

Figure 6:
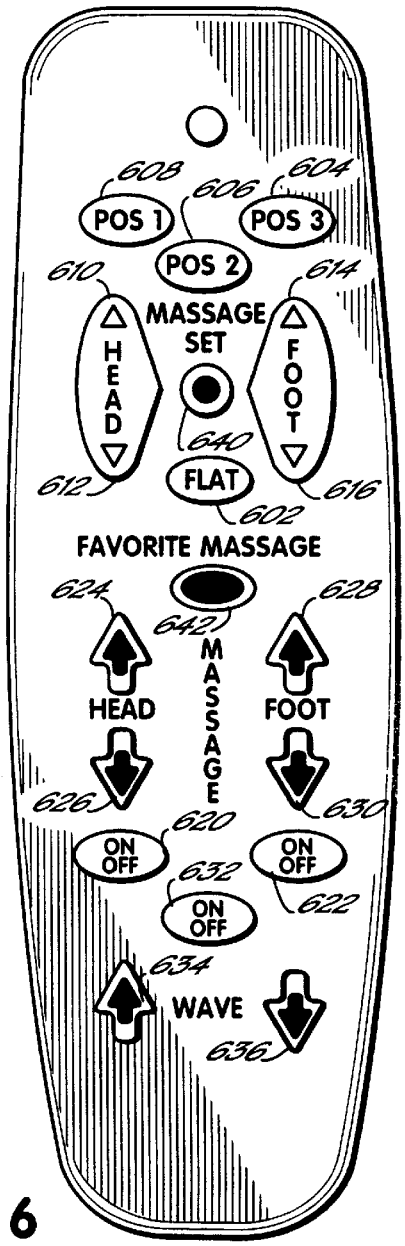
FIG. 6 is a front elevation view of a remote control to be used with the adjustable bed of the present invention.

The operation of the adjustable bed 20 is commanded by a remote control as illustrated in FIG. 6. The user can move the bed to a flat position or three preset positions using the push buttons 602–608. In addition, the head section 76 is selectively raised and lowered with the respective push buttons 610, 612. Similarly, push buttons 614, 616 are used to raise and lower, respectively, the thigh and foot sections 80, 82. Massage motors 150, 152 are attached to the respective lower sides 107, 129 of the head and foot sections 76, 80, respectively, and are turned ON and OFF by the push buttons 620, 622. If the massage motors 150, 152 are turned ON, the speed of the head and foot massage motors may be selectively increased and decreased using the push buttons 624–630. In addition, the speed of the massage motors 150, 152 may be continuously increased and decreased in a cyclic or wave-like manner. In other words, the speed of the massage motors 150, 152 is gradually decreased from a current speed to a minimum speed and then gradually increased from the minimum speed back up to the current speed. That process is repeated providing a wave-like sensation. The wave operation is initiated by actuating the push button 632. The frequency of the wave action, that is, the rate at which the vibrator motor speed is cycled between maximum and minimum values is selectively increased and decreased using push buttons 634, 636, respectively. Thus actuating push button 634 increases the frequency of the wave action by reducing its period, that is, the time required to change the current vibrator motor speed to a minimum speed. After the various massage push buttons 634–636 have been used to select the desired head and foot massage speeds and frequency, a massage set push button 640 may be used to store those massage settings. Thereafter, a favorite massage push button 642 may be used to immediately implement the stored settings without having to recreate the settings using push buttons 634–636.

Figure 7:
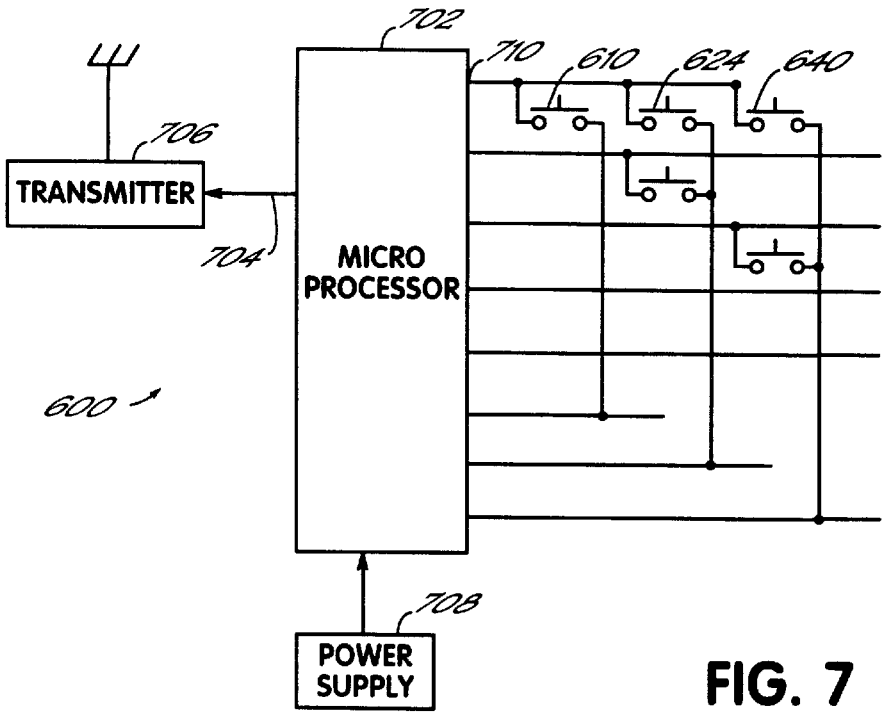
FIG. 7 is an electrical schematic block diagram of the remote control of FIG. 6.

A schematic diagram of the remote control of FIG. 6 is illustrated in FIG. 7. A microprocessor 702 is responsive to the activation of the various push buttons 610, 624, etc. and produces an output signal on line 704 to a transmitter 706 that transmits signals representing the continuing activation of one or more of the push buttons. The microprocessor 702 and transmitter 706 are powered by a power supply 708, for example, batteries. The microprocessor 702 is able to detect the state of a plurality of push buttons, for example, 610, 624, 640, on a single input using known multiplexing techniques.

Figure 8:
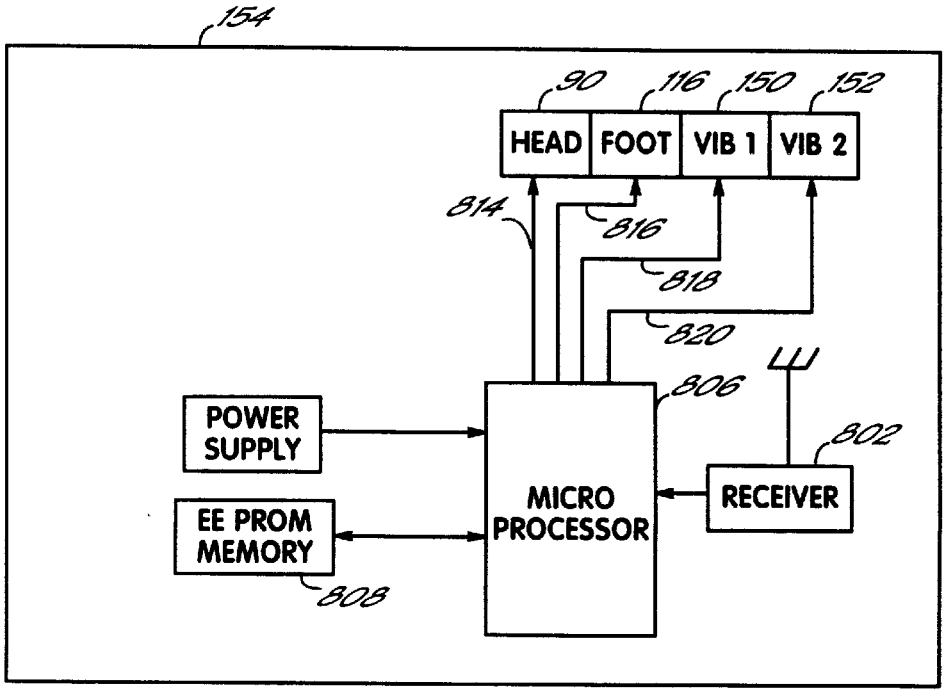
FIG. 8 is an electrical schematic block diagram of the motor control for the adjustable bed of the present invention.

The signals transmitted by the transmitter 706 are received by a receiver 802 of FIG. 8 within a main bed control unit 154. The main bed control 154 is attached to a lower surface 156 of centerboard 78 of FIG. 1 so that it is located between the motors 90, 116 and motor supports 94, 100. The main control 154 has a microprocessor 806 that decodes and temporarily stores the commands represented by the activated push buttons 602–636 on the remote control 600. The microprocessor 806 includes standard RAM and EPROM memory within the processor itself; and in addition, is connected to a nonvolatile EEPROM memory 808. The microprocessor 806 provides run commands on output lines 814, 816 to the head and foot motors 90, 116, respectively. The run commands also define the direction of motor operation depending on the location of the desired head or foot board positions with respect to their current positions.

There is no feedback to the microprocessor 806 with respect to the actual positions of the head, thigh and foot boards 76, 80, 82, respectively. Further, the motors 90, 116 are simply AC motors that can be commanded to rotate either clockwise or counterclockwise. However, the motors do run at an approximately constant velocity. Therefore, the time required for the head section 76 to move from a flat position to a fully inclined position, is known, for example, approximately 30 seconds. Therefore, the microprocessor 806 maintains a current position buffer representing the amount of time the head motor 90 is commanded to move in one direction or the other with respect to the flat position. Further, the microprocessor 806 measures the time that a motor command is provided from the receiver 802. For example, if the user holds the head up push button 610 depressed for 5 seconds, the microprocessor 806 commands the head motor 90 to move upward for that same period of time and a current position buffer for the head section 76 will be incremented by a number correlated to 5 seconds. Therefore, the head position defined by the preset position buttons 604–608 can also be defined In terms of a time from 0–30 seconds that the head motor must move to achieve the desired preset position from the flat position. Thus, by algebraically comparing the stored preset position in terms of time, to the current position buffer for the head motor, the direction and amount of time that the head motor must be run to achieve the predetermined position may be determined.

Figure 9A:
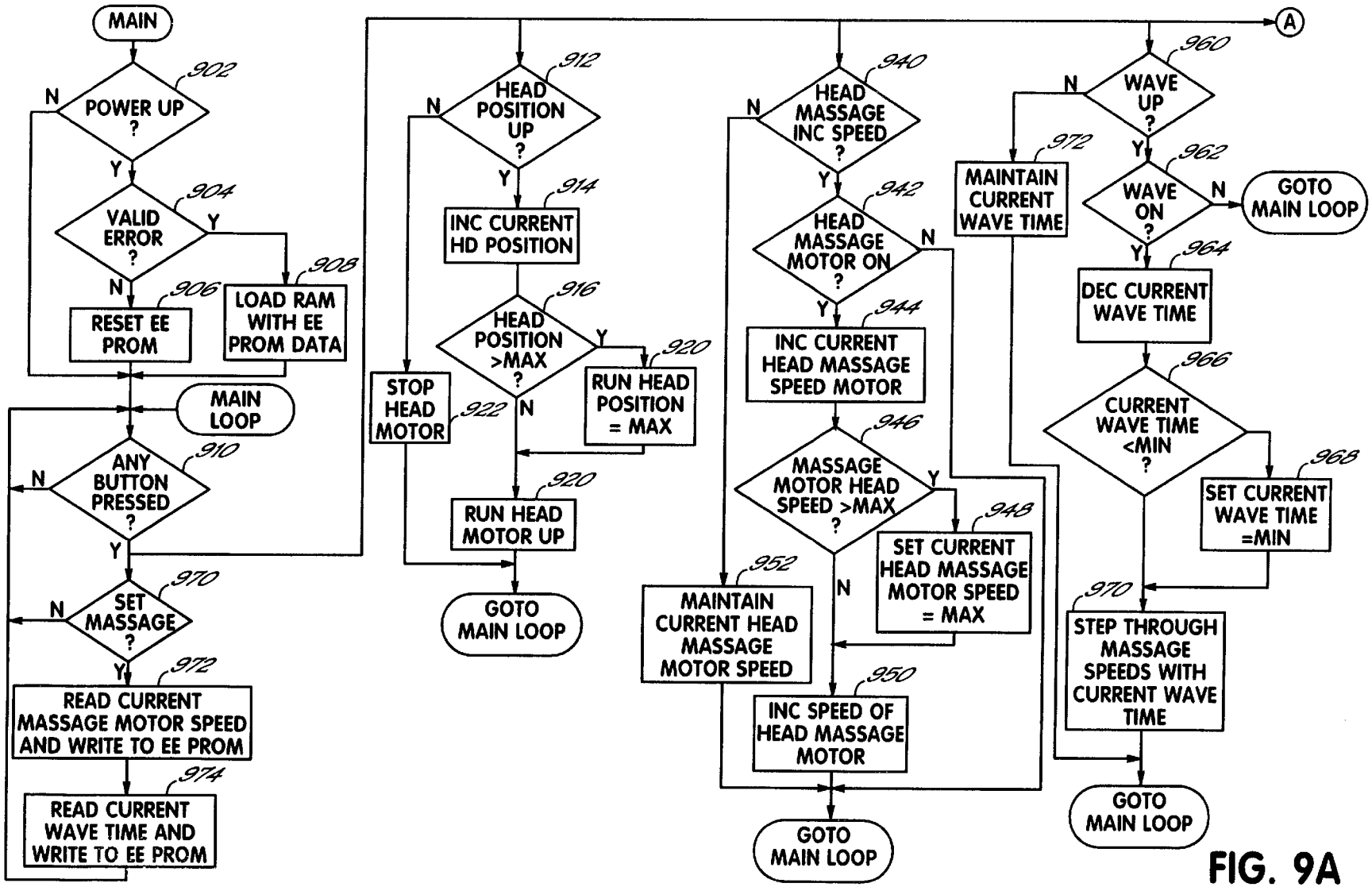
FIGS. 9A and 9B illustrate a partial flow chart of operations of the motor control in response to the actuation of selected push buttons on the remote control of FIG. 6 in accordance with the principles of the present invention.
Figure 9B:
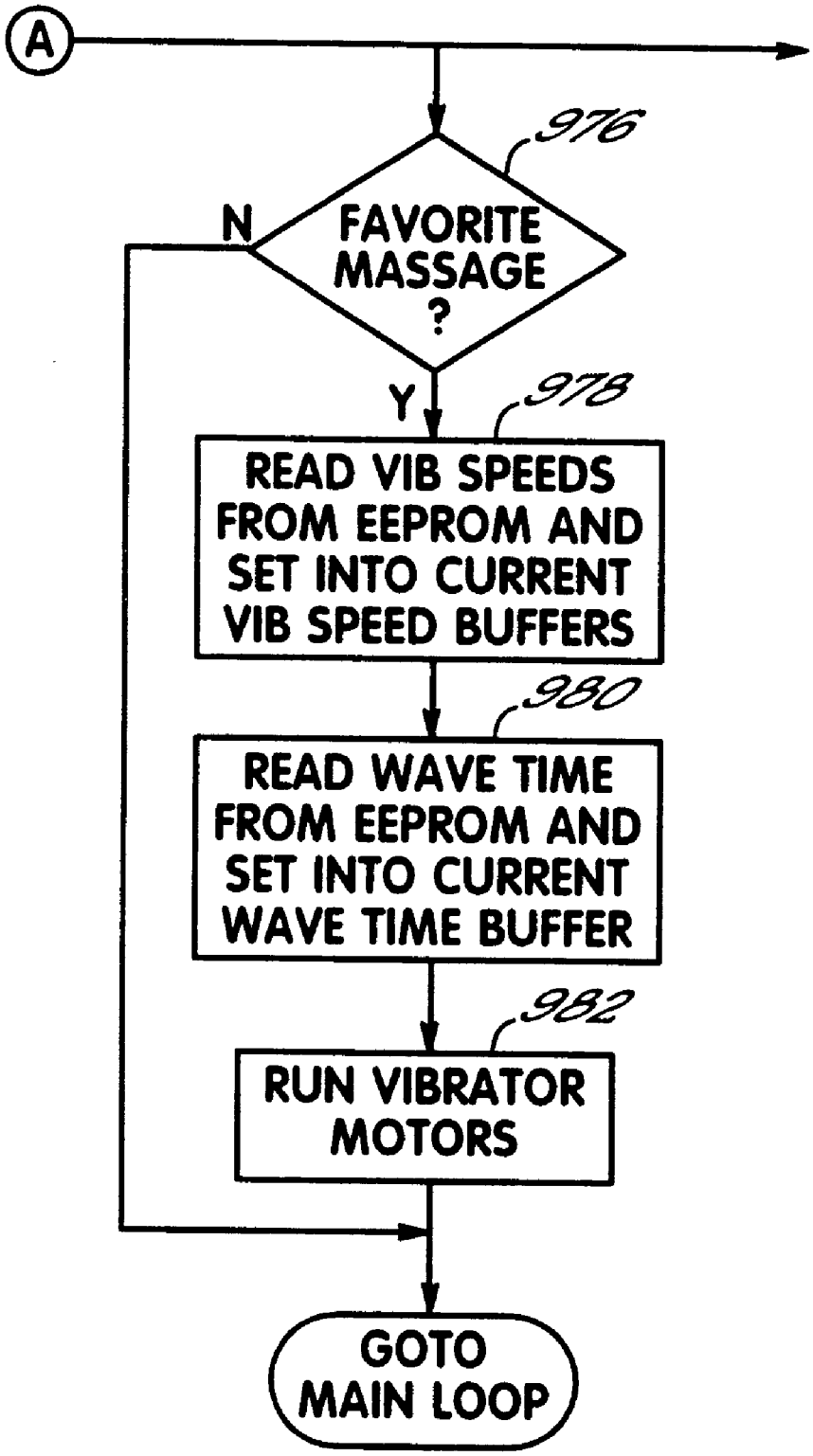

A portion of the operation of the bed control 154 is illustrated in the flow chart of FIGS. 9A and 9B. At 902, the control 154 determines whether power is being applied for the first time. During the initial application of power, the microprocessor 806 does not know the current configuration of the bed, and therefore, at steps 904–908, the control 154 establishes default values for head and foot position, vibrator speed and vibrator wave time. For example, the current head and foot position buffers are equal to a flat position. Then at 910, the processor 806 determines whether any buttons are pressed. If a button is pressed, the processor then identifies the button; and if, for example, at 912, the head up push button 610 is detected as being activated, the processor 806 increases the value in time units in a current head position buffer at 914. The current head position is then compared at 916 with a predetermined maximum position, for example, the fully inclined position. In time units, the maximum position is determined by the amount of time required to move the head board 76 from the flat position to the fully inclined position, for example, 30 seconds. If the current head position has a value in excess of 30 seconds, the processor 806 at 918 sets the current head position to the maximum value of 30 seconds. The microprocessor 806 then at 920 provides an output signal over line 814 to turn on the head motor 90 and rotate the head motor in a direction to move the head board 76 up. If the head up push button 610 is held depressed, the above process iterates, and the time value in the current head position buffer is incremented with each iteration. When the microprocessor 806 detects at 912 that the head position push button 610 has been released, the microprocessor 806 at 922 terminates the run motor command on output line 814, thereby stopping the head motor 90 immediately upon the user releasing the button 610.

Similarly, if the microprocessor 806 detects at 940 that the increase head massage speed push button 624 is depressed, it first determines at 942 whether the head massage motor has been turned ON. If so, the microprocessor 806 then at 944 increases the value in the current head massage motor speed buffer, and, at 946, determines whether the current massage motor speed is greater than a maximum speed. If it is, the microprocessor 806 at 948 will set the current head massage motor speed equal to the maximum value; and thereafter, at 950, the processor 806 provides an output signal on line 818 to the head massage motor 150 to increase the speed of the head massage motor 150. Again, if the user holds push button 624 depressed, the above process iterates with the speed of the head massage motor being increased with each iteration. When the microprocessor 806 detects at 940 that the push button 624 has been released, the microprocessor 806 changes the output signal on line 818 to maintain the current head massage motor speed.

If, at 960, the microprocessor 806 detects that the wave up push button 634 is being depressed, it then determines at 962 whether the wave feature has been turned ON using push button 632. If so, the processor 806 decrements the current wave time buffer at 964. Thus, the time interval during which the massage motor speed is changed from its current value to a minimum value is reduced, thereby increasing the frequency of the wave effect. The microprocessor 806 then at 966 determines whether the current wave time buffer value is less than a minimum time; and if so, the wave time buffer is set to the minimum time value at 968. Thereafter, the microprocessor 806 provides output signals on line 818 to the head massage motor 150 to continuously cycle the massage motor speed between high and low speed values over time intervals equal to the wave time buffer value. The above process depicted by steps 960–972 continues for as long as the wave up push button 634 is held depressed; and, as the time interval used to cycle the massage motor between high and low speeds decreases, the frequency or intensity of the massage wave action increases. When the push button 634 is released, the microprocessor 806 at 960 detects that release and changes the output signals on line 818 to maintain the current wave time for cycling vibrator motor speed between high and low values.

If at any time the microprocessor 806 detects that the user has pushed the set massage push button at 970, the processor then at 972 reads the values of the current speeds for the head and foot motors 150, 152 and stores those values in the EEPROM 808. Thereafter, the microprocessor 806 at 974 reads the time value in the current wave time buffer and writes that time value to the EEPROM memory 808. If the processor 806 detects at 976 that the favorite massage button is depressed, it then at 978 reads the motor speeds for the head and foot vibrator motors 150, 152 from the EEPROM 808 and sets those values into the respective current vibration speed buffers. Similarly, at 980, the processor then reads the wave time value from the EEPROM 808 and sets that value into the current wave time buffer. Thereafter, the microprocessor 806 at 982 provides output signals on lines 818 and 820 to the respective head and foot vibration motors 150, 152 to operate those motors in accordance with the vibration speed and wave time values that are stored in the EEPROM 808. Bed controls of the type described above including the remote control 600 and the bed control 154 are commercially available from Beta Raven Inc. of St. Louis, Mo.

Figure 2:
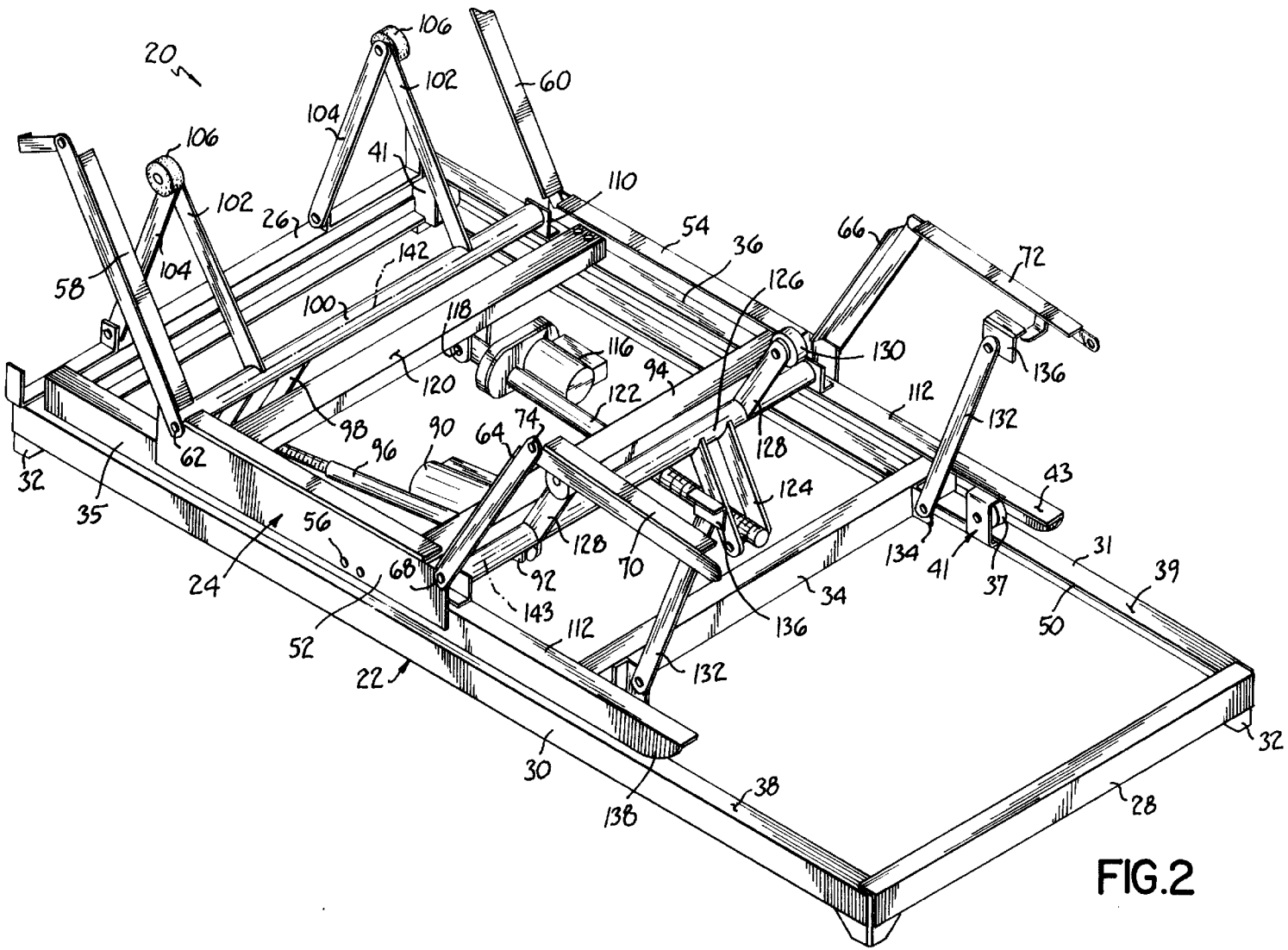
FIG. 2 is a perspective view of the wallhugger bed frame illustrated in FIG. 1 with the head and foot frame section components raised to their uppermost positions.

In use, to raise the head end of the bed, the user depresses the head up push button 610; and as previously described, the motor control 154 operates the head motor 90 in a manner to cause the drive shaft 96 to extend linearly away from the motor 90 toward the head end of the bed. By extending the drive shaft 96, the motor 90 rotates the head actuator shaft 100 in a generally clockwise direction as illustrated In FIG. 1. Thus, the head lift arms 102 move in a clockwise direction, thereby elevating the head lift rollers 106 and the head board 76. However, the head arm links 104 are connected to the lower frame 22 and are rotating counterclockwise as viewed in FIG. 1. As the head lift rollers 106 are elevated, the head actuator shaft 100 and the entire upper frame 24 are translated toward the head end rail 26. That motion continues until the head reaches its maximum elevation as illustrated in FIG. 2; and during that motion, the head end of the upper frame 24 hugs the head end of the lower frame 22 or an adjacent wall, thus, giving rise to the "wallhugger" label.

Referring to FIG. 1, the foot ends of the respective left and right side rails 35, 36 of the upper frame 24 are generally aligned with the foot end rail 28 of the lower frame 22 with the bed in its generally horizontal position. When the head section 76 has been raised to its fully elevated position as shown in FIG. 2, the foot ends 138 of the respective left and right side rails 35, 36 of the upper frame 24 have translated approximately 18 inches toward the head rail 26. Thus, as the head section is elevated, the head and shoulder position of a user in the bed remain in a generally fixed position relative to the length of the bed and appliances, and furniture adjacent the head end of the bed. Consequently, the user continues to have full access to such devices as telephones, lamps and tabletops regardless of the elevation of the head section 76.

To elevate the foot section, the user actuates push button 614 which causes the motor control 154 to provide output signals on line 816 (FIG. 8) that operate the foot motor 116. The foot motor 116 extends its drive shaft 122 toward the foot end of the bed. Extension of the drive shaft 122 simultaneously rotates the crank arm links 124, foot actuator shaft 126 and foot lift arms 128 in a generally counterclockwise direction as viewed in FIG. 1. That results in the foot lift rollers 130 pivoting the thigh board 80 with respect to the center board 78. As the thigh board pivots generally counterclockwise, the foot lift arms 132 also rotate counterclockwise and lift the foot board 82, thus the thigh and foot boards 80, 82 move in unison until the thigh board 82 is elevated it its maximum position, as illustrated in FIG. 2. When the thigh board is in its fully elevated position, the foot board 82 is angled at approximately 5° below the horizontal.

The design of the adjustable bed 20 illustrated in FIGS. 1–9 has several advantages. First, the head and foot actuator shafts 100, 126, respectively, are mounted about fixed axes of rotation that are coincident with the respective shaft center lines 142, 143. Thus, the actuator shafts 100, 126 are simply pivotally mounted within brackets 108, 110 which are attached to the top horizontal flange 112 of the left and right side rails 35, 36, respectively. The axes of rotation of the shafts 100, 126 pass through the brackets 108, 110 and are above the vertical flanges of the side rails 35, 36. Such a design is substantially simpler, less complex and less expensive than prior designs in which the center lines of the actuator shafts rotate about a second noncoincident axis of rotation.

Second, the motors 90, 116 are mounted side by side to respective motor mount cross rails 94, 120 below the stationary center board 78. By mounting the motors 90, 116 side by side under the center section 78, the motors 90, 116 and respective drive shafts 96, 122 are more hidden and out of view when the head and foot sections are elevated. Further, the motors 90, 116 are mounted on independent cross rails and thus, there is good mechanical isolation. Further, such a motor location further permits a motor with a longer stroke while at the same time allowing the overall length of the bed to be reduced.

Third, the foot lift arms 132 are located on the foot end rail 34 well inside the perimeter of the side rails 35, 36 of the upper frame 24. That structure is in contrast to prior beds in which the foot lift arms are pivotally connected to brackets attached to the inner or the outer surfaces of the left and right side rails 35, 36 of the upper frame 24. When the foot lift arms are connected outside the perimeter of the upper frame 24, trim pieces and material that are also located outside the perimeter of the upper frame 24 must be spaced from the side rails 35, 36 so that there is no interference with the operation of the foot lift arms. Thus, by relocating the foot lift arms 132 on a cross rail 36 to a location inside the side rails 35, 36, the trim pieces may be moved closer to the side rails 35, 36, thereby narrowing the footprint of the bed and providing a more compact and attractive appearance. In addition, with the foot lift arms 132 disconnected from the side rails 35, 36, the side rail structure is greatly simplified, and there is less chance for interference between the lift arms 132 and other bed components.

Fourth, the upper frame 26 is mounted on the lower frame 24 utilizing wheels supported at the corners of the upper frame. The wheels are mounted in the C-shaped brackets that have tracking bumpers 46 attached to the lower ends of the brackets 41. The bumpers are intended to contact the inner surface of the vertical flange of the lower side rails 30, 31 upon the upper frame deviating from its desired linear motion. Thus, by utilizing a wheel supported in a simple and inexpensive C-shaped bracket, the upper frame is maintained in its desired track with respect to the lower frame 24.

The described bed control has a further advantage of providing massage set and replay push buttons 640, 642. By depressing the single push button 640, the speeds of the head and foot massage motors 150, 152 and the selected wave time for the massage is stored. Thereafter, by pushing the favorite massage button 642, those massage motor speeds and wave time are immediately provided by the bed control 154 to the massage motors 150, 152, thereby providing the user's favorite massage setting with the push of a single button. Thus, desired massage settings are uncoupled from the position settings, and the user can store and recall desired massage settings independent of the position of the bed. Further, the massage settings do not change if the user selects a different bed position.

Thus, the adjustable bed of the present invention provides a simpler and less expensive construction that provides a more compact and attractive adjustable bed. In addition, in combination with more sophisticated controls, the adjustable bed of the present invention is very attractive as a leisure bed for residential use.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, the massage set and replay buttons 640, 642 are described with respect to the setting of massage motor speed and massage wave time or frequency. As will be appreciated, different bed suppliers provide different control capabilities with respect to setting the massage motors. The present invention should not be considered limited by the described massage settings of massage speed and wave time, but the set and replay buttons 640, 642 may be used to store and replay any number of different massage motor variables.

Therefore, the invention in its broadest aspects is not limited to the specific detail shown and described. Consequently, departures may be made from the details described herein without departing from the spirit and scope of the claims which follow.

What is claimed is:

1. An adjustable bed comprising:

a bed frame having a head end and a foot end;

a center support section supported by the bed frame and having a head end and a foot end;

a head support section having one end pivotally attached to the head end of the center support section;

a thigh support section having one end pivotally attached to the foot end of the center support section;

a first member connected to the bed frame below and between the head and foot ends of the center support section and closer to the head end than the foot end of the center support section;

a second member connected to the bed frame at a location below and between the head and foot ends of the center support section and between the first member and the foot end of the center support section;

a first motor and drive mechanically connected between the second member and the head support section and moving the head support section through a pivoting motion with respect to the center support section; and a second motor and drive mechanically connected between the first member and the thigh support section and moving the thigh support section through a pivoting motion with respect to the center support section.

2. The adjustable bed of claim 1 wherein the bed frame further includes a head rail, a foot rail and a pair of parallel side rails connected to ends of the head and foot rails and the first and second members are connected to the side rails.

3. The adjustable bed of claim 1 wherein the first motor is pivotally mounted to the second member and the second motor is pivotally mounted to the first member.

4. The adjustable bed of claim 3 wherein the first and second members have respective mounting links and the first and second motors are pivotally connected to the respective mounting links of the second and first members, respectively.

5. The adjustable bed of claim 4 wherein the mounting links extend below the first and second members.

6. The adjustable bed of claim 2 wherein the first and second members are mounted to an upper surface of the side rails of the bed frame.

7. An adjustable bed comprising:

a bed frame having a head rail, a foot rail and a pair of parallel side rails connected to ends of the head and foot rails, each of the side rails having intersecting horizontal and vertical members;

a center support section supported by the bed frame and adapted to support hips of a user;

a first support section having one end pivotally attached to one end of the center support section;

a first motor mounted to the frame;

a first actuator shaft extending between and rotatably supported by the side rails of the bed frame to provide an axis of rotation for the first actuator shaft coincident with a longitudinal centerline of the first actuator shaft but not intersecting the vertical members of the side rails of the bed frame, the first actuator shaft being mechanically connected between the first motor and the first support section to pivot the first support section with respect to the center support section in response to the first motor rotating the first actuator shaft with respect to a centerline of the first actuator shaft.

8. The adjustable bed of claim 7 wherein the first actuator shaft is mounted with its axis of rotation above the horizontal members of the side rails.

9. The adjustable bed of claim 8 wherein the bed frame further comprises brackets for mounting the first actuator shaft.

10. The adjustable bed of claim 9 wherein a bracket is mounted on the horizontal member of each of the side rails.

11. The adjustable bed of claim 7 wherein the first actuator shaft has a lift arm extending generally radially therefrom with a distal end of the lift arm bearing against an underside of the first support section and pivoting the first support section in response to rotation of the first actuator shaft.

12. The adjustable bed of claim 11 wherein the first actuator shaft has a motor mount link extending generally radially therefrom with a distal end of the motor mount link coupled to the motor.

13. The adjustable bed of claim 12 wherein the lift arm and the motor mount link are separated on the first actuator shaft by an angle of approximately 60°.

14. An adjustable bed comprising:

a bed frame having a head rail, a foot rail and a pair of parallel side rails connected to ends of the head and foot rails;

a center support section supported by the bed frame and having a head end and a foot end;

a thigh support section having one end pivotally attached to the foot end of the center support section;

a foot support section having one end pivotally attached to an opposite end of the thigh support section;

a cross member extending between the side rails;

linkage having one end attached to the foot support section and an opposite end attached to the cross member at a location between and not in contact with the side rails.

15. The adjustable bed of claim 14 wherein the opposite end of the linkage is pivotally coupled to the cross member.

16. The adjustable bed of claim 15 wherein the one end of the linkage is pivotally connected to a lower side of the foot support.

17. The adjustable bed of claim 16 wherein the cross member is the foot rail.

18. The adjustable bed of claim 14 wherein the linkage is a pair of parallel lift arms.

19. An adjustable bed comprising:

a lower bed frame having a lower head rail, a lower foot rail and a lower pair of parallel side rails connected to ends of the lower head and foot rails, each of the lower side rails having intersecting longitudinal horizontal and vertical members;

an upper bed frame having an upper head rail, an upper foot rail and an upper pair of parallel side rails connected to ends of the upper head and foot rails, each of the upper side rails having intersecting longitudinal horizontal and vertical members;

a plurality of wheeled supports connected to the upper bed frame and supporting the upper bed frame on the lower bed frame, each of the plurality of wheeled supports including a generally C-shaped bracket having an upper leg connected to the upper bed frame, a wheel rotatably supported on one side by the C-shaped bracket and on an opposite side by the upper bed frame, the wheel in rolling contact with a surface on a respective horizontal member of a respective side rail of the lower bed frame, and a cap attached to a lower leg of the C-shaped bracket and normally spaced a distance from a respective vertical member of a respective side rail of the lower frame, the cap contacting the vertical member of the lower frame upon the wheel moving toward a side of the lower bed frame, thereby maintaining the wheel on a desired track on the lower bed frame.

20. The adjustable bed of claim 19 wherein an upper end of each of the C-shaped brackets is connected to one of the upper side rails.

21. The adjustable bed of claim 20 wherein a lower end of each of the C-shaped brackets extends below the horizontal member of one of the lower side rails.

22. The adjustable bed of claim 21 wherein the cap is normally spaced a predetermined distance from a lower surface of the horizontal member of one of the lower side rails.

23. The adjustable bed of claim 22 wherein the upper end of each of the C-shaped brackets is connected to the horizontal member of one of the upper side rails.

* * * * *

UNITED STATES PATENT AND TRADEMARK OFFICE

CERTIFICATE OF CORRECTION

PATENT NO. : 6,101,647
DATED : August 15, 2000
INVENTOR(S) : Stroud et al.

It is certified that error appears in the above-identified patent and that said Letters Patent is hereby corrected as shown below:

Column 4,
Line 50, delete "illustrates" and insert therefor -- illustrate --.
Line 55, after "mounted", delete "to".

Column 6,
Line 23, delete "foot left" and insert therefor -- left foot --.

Column 7,
Line 47, delete "In" and insert therefor --in --.

Column 9,
Line 64, after "elevated", delete "it", and insert therefor -- to --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*